US005365751A

United States Patent [19]

Mikesell et al.

[11] Patent Number: 5,365,751

[45] Date of Patent: Nov. 22, 1994

[54] UNIVERSAL ACCUMULATOR DEHYDRATOR ASSEMBLY

[75] Inventors: Donald E. Mikesell; Kenneth B. Newman, both of Dayton, Ohio

[73] Assignee: General Motors Corporation, Detroit, Mich.

[21] Appl. No.: 120,198

[22] Filed: Sep. 13, 1993

[51] Int. Cl.[5] ..... F25B 43/00

[52] U.S. Cl. ..... 62/298; 62/503

[58] Field of Search ..... 62/298, 503, 512, 326

[56] References Cited

U.S. PATENT DOCUMENTS

| | | | |
|---|---|---|---|
| 2,623,607 | 12/1952 | Bottum | 62/503 |
| 3,785,164 | 1/1974 | Wrenn | 62/129 |
| 4,581,903 | 4/1986 | Kerry | 62/503 |
| 4,675,971 | 6/1987 | Masserang | 29/422 |
| 4,866,951 | 9/1989 | Masterson, II | 62/503 |
| 4,938,037 | 7/1990 | Carlisle, Jr. | 62/503 |
| 5,048,309 | 9/1991 | Carlisle | 62/503 |
| 5,146,766 | 9/1992 | Martins | 62/298 |
| 5,191,775 | 3/1993 | Shiina et al. | 62/503 |

FOREIGN PATENT DOCUMENTS

| | | | |
|---|---|---|---|
| 289714 | 11/1989 | Japan | 62/298 |

*Primary Examiner*—Henry A. Bennet
*Assistant Examiner*—William C. Doerrler
*Attorney, Agent, or Firm*—Patrick M. Griffin

[57] ABSTRACT

A modular accumulator dehydrator assembly for a vehicle air conditioning system uses an array of common components to provide configurations adapted to fit several possible orientations and locations of lines in the system. A cylindrical canister is closed by an end cap, to which a block is attached by a single bolt. Either a bottom or top feed set of inlet pipes is inserted in the end cap, depending on the chosen orientation for the canister. Then, a pair of tubes is added to the outside of the block, which are turned and bent to the proper position for joining to the compressor and evaporator line before brazing in place in the block. A single bolt is tightened to join the block to the end cap, which tightens a pair of O-ring seals to seal the block to end cap connection.

1 Claim, 3 Drawing Sheets

UNIVERSAL ACCUMULATOR DEHYDRATOR ASSEMBLY

This invention relates to vehicle air conditioner system accumulator dehydrator assemblies in general, and specifically to such an assembly that has a modular, kit form, capable of being adapted to work with any one of several systems that have variant, but predetermined, locations for the lines that are attached to the assembly.

BACKGROUND OF THE INVENTION

Vehicle air conditioning systems include an evaporator from which heavy vapor that has been heated in the vehicle cooling process exits to a compressor. Intermediate the evaporator and compressor is an accumulator dehydrator assembly, often called an A/D assembly, which is basically a cylindrical canister that allows liquid refrigerant to settle out. The compressor, therefore, draws refrigerant indirectly from the evaporator, out of the top of the canister reservoir and primarily in vapor form. The incidence of liquid refrigerant in the compressor, so called slugging, is thereby minimized. In addition, bags of desiccant are typically included in the canister to dry the refrigerant.

The A/D assembly, as well as the evaporator or input line to it, the compressor or output line from it, the compressor itself, and myriad other components are located under the hood or cowl of the vehicle. With the advent of more aggressive cab forward body designs and lower hood lines, there is less and less underhood space available, and the need for ever more compact designs. In addition, there is the need for more flexibility in locating and orienting the A/D assembly when body designs are changed or modified, and the need to commonalize more and more components to serve several body designs.

Typical A/D assembly designs are well illustrated in U.S. Pat. No. 4,675,971. The lines in and out of the canister usually are fitted to the sides of the canister, near the top in some designs, out of bottom for others. Each design is dedicated and inflexible, and if the orientation or location of the lines were changed, the canister design would have to be changed, as well. Attempts have been made to provide a more universal or adaptable design. An example may be seen in U.S. Pat. No. 4,866,951. One of the ports to the canister, the input connector from the evaporator, is placed at the center of the canister axis, and is designed to be rotatable to all points of the compass, in effect. A is not solid, as a weld or braze would be, and is always subject to leakage. The designs described above also are capable of only one canister orientation, that is, top or bottom feed only. In addition, each input and output line is separately attached to a fitting on the canister by its own threaded connection, each of which has to be separately applied to add or remove the canister.

SUMMARY OF THE INVENTION

The invention provides a universal accumulator dehydrator assembly in a modular, kit form with a maximum number of common parts and minimum number of differing parts that can be adapted to a great number of air conditioning systems with varying line locations and orientations.

In the preferred embodiment disclosed, the parts that make up the kit are a generally cylindrical canister with one open end and no other openings through it, an end cap that closes the open end, a pair of alternative top feed and bottom feed inlet and outlet pipes that fit through the end cap inside the canister, a detachable block that abuts the end cap, and a pair of cylindrical, bendable input and output tubes. The block has a pair of protruding sleeves on its inner surface that fit closely into the end cap, each surrounded by an O-ring, and a central threaded bolt that tightens into the end cap. Cylindrical bores in the outer surface of the end cap, coaxial to the sleeves and close to the center axis of the block, receive the input and output tubes closely, but not so tightly as to prevent initial turning.

For any given design application, the location and orientation of the input and output lines to the A/D assembly are treated as a given. The first step involved is to choose a top or bottom feed orientation for the canister, and to then choose the corresponding pair of inlet and outlet pipes for the end cap. Next, each tube is bent, if necessary, into the proper shape, and turned to the proper orientation relative to the block, to meet a respective input and output line. Then, each tube is affixed by welding or brazing it into its respective block bore, creating a complete, static seal. Finally, each tube is joined to its respective line, and the block is bolted to the end cap. The protruding sleeves enter the end cap and the O-ring seals are compressed. The single act of tightening the one bolt finishes the assembly and the necessary sealing. Every seal is static and complete. The envelope of space occupied by the assembly is minimized, because nothing protrudes from the side wall of the canister, and because the block tubes are close to the central axis.

DESCRIPTION OF THE PREFERRED EMBODIMENT

These and other advantages of the invention will appear from the following written description and from the drawings, in which.

Figure 1:
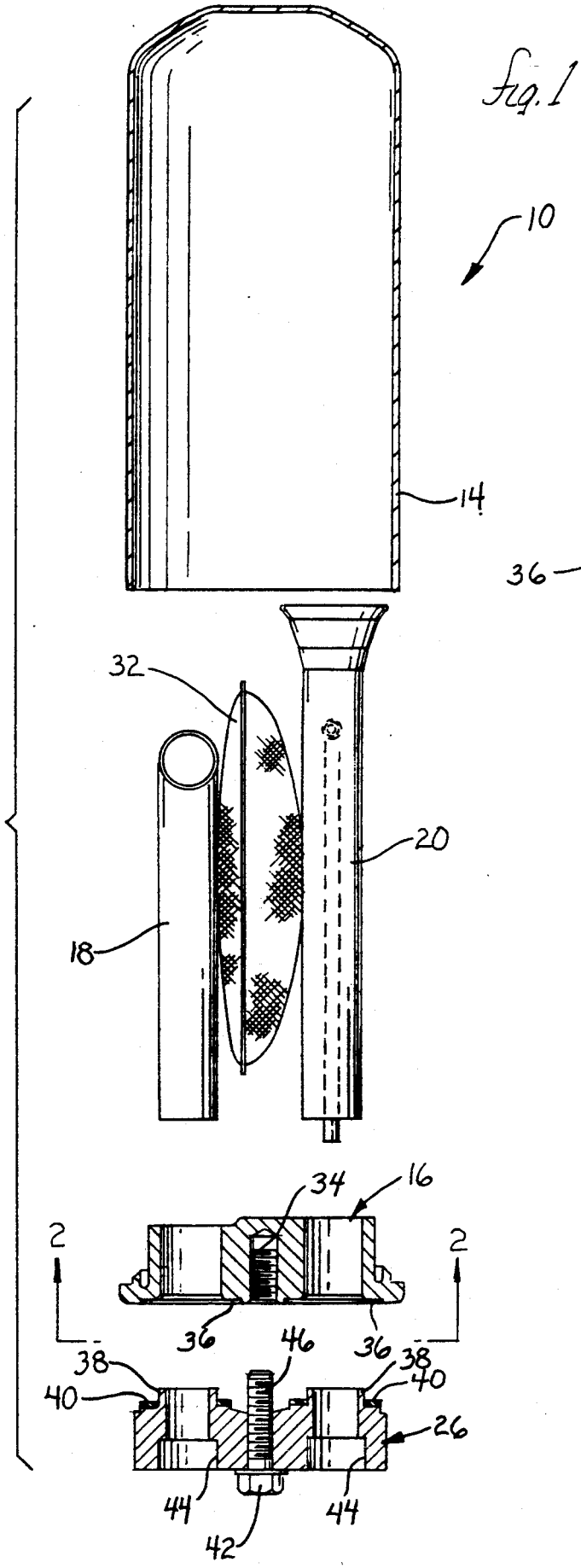
FIG. 1 is an exploded, disassembled view of a bottom feed embodiment of the invention, showing the interior pipes and desiccant bag in elevation and the other components in cross section.
Figure 2:
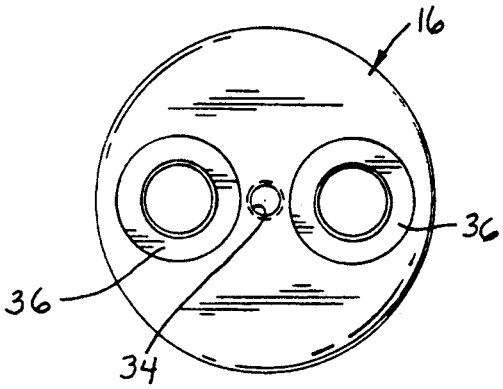
FIG. 2 is an end view of the end cap taken from the plane 2—2 of FIG. 1.
Figure 3:
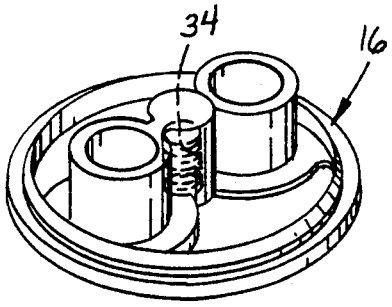
FIG. 3 is a perspective view of the inner surface of the end cap.
Figure 4:
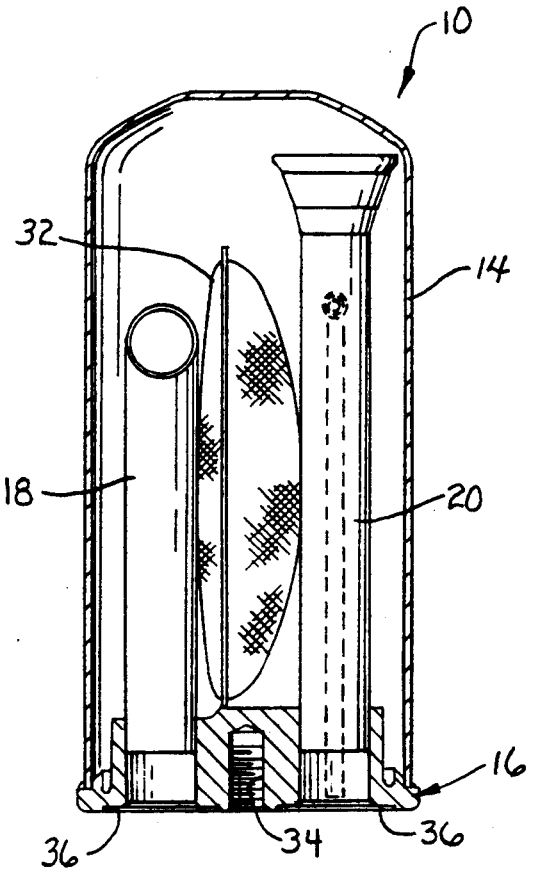
FIG. 4 is an assembled view of the bottom feed embodiment without the block.
Figure 5:
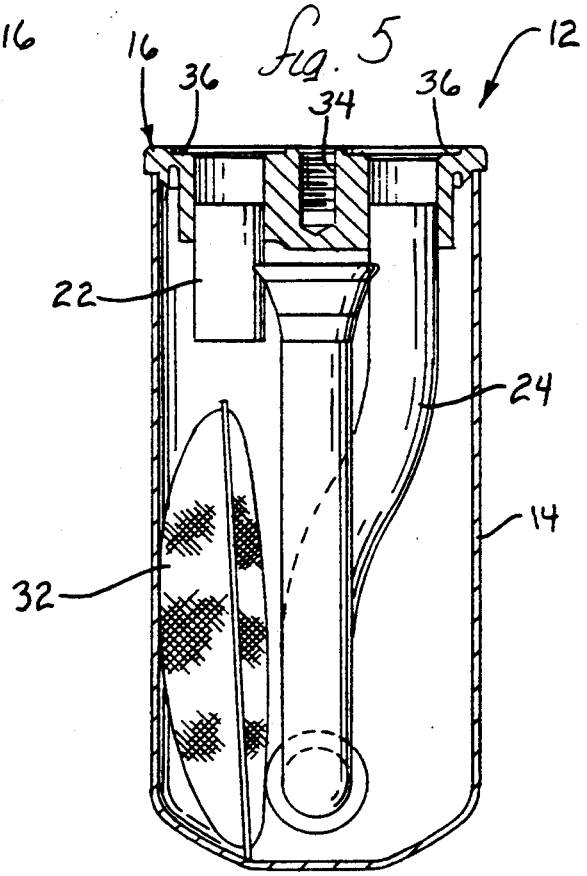
FIG. 5 is an assembled view of the top feed embodiment without the block.
Figure 6:
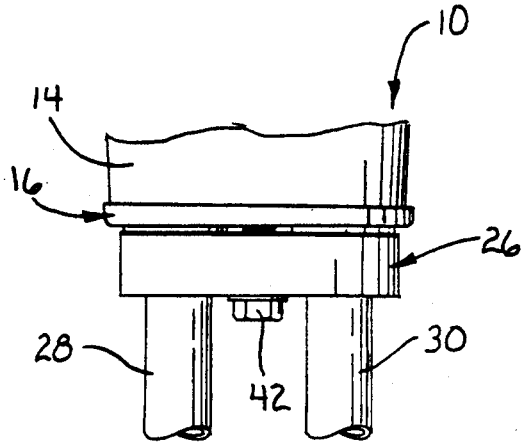
FIG. 6 is a view of the end of the bottom feed embodiment with the tubes in a straight orientation.

Referring first to FIGS. 4, 5 and 6, two configurations, or embodiments, of the invention, a so-called bottom feed configuration indicated generally at (10), and a top feed configuration (12), are illustrated. Each is made up in modular fashion out of the same basic catalog or kit of parts. These include a cylindrical canister (14), an end cap, indicated generally at (16), a pair of equal diameter bottom feed inlet and outlet pipes (18) and (20), a pair of same diameter top feed inlet and outlet pipes (22) and (24), a detachable block indicated generally at (26), and a pair of bendable inlet and outlet tubes (28) and (30). Only the inlet and outlet pipes 24) vary between the two possible configurations (10) and (12), although the tubes (28) and (30), as their name implies, may be bent to suit different applications. In addition, a conventional desiccant bag (32) is used in both cases.

Referring next to FIGS. 1–5, additional details of the particular components used in the initial build of the invention. The description applies to both embodiments, because of the high level of common components across the two. Canister (14) is formed from sheet aluminum, with only one open end and no interruptions or holes in its cylindrical side wall. End cap (16) is cast aluminum, and sized to fit closely into and close canister (14), to which it is welded to provide a complete seal. At the center of cap (16), coaxial to the center axis of canister (14), is a threaded barrel (34). Before cap (16) is welded in place, an orientation, either bottom feed (FIG. 4) or top feed (FIG. 5) is chosen, based on input and output line location (not illustrated) for the particular vehicle. The choice would also depend on location of the hood line and other components. Once chosen, a corresponding inlet and outlet pipe are chosen, either (18) and (20) for the bottom feed orientation, or (22) and (24) for the top feed orientation. All are of the same diameter, and all fit closely through the end cap (16), close to, though obviously not directly on, the center axis. On the outer surface of cap (16), a pair of annular seal pockets (36) coaxially surround each pipe location, for a purpose described below. Once the proper orientation is chosen and pipes added, the desiccant bag (34) is inserted, and then end cap (16) is welded in place. This creates the sub or intermediate assembly shown in FIG. 4 or FIG. 5.

Referring again to FIG. 1, further detail on block (26), the final component, is illustrated. The inner surface of block (26) has a pair of protruding cylindrical sleeves (38) that are sized to fit partially into the end cap (16), concentric to the ends of the pipes (18) and (20), or (22) and (24). Surrounding each sleeve (38) is an O-ring type seal (40) sized to fit into a respective seal pocket (36). The sleeves (38) also lie close to, though not right on, the center axis of block (26), with a threaded bolt (42) being at the center. Therefore, there is not a preferred orientation of block (26) relative to end cap (16) per se. Machined into the outer surface of block (26), coaxial to each sleeve (38), is a pair of equal diameter cylindrical bores (44), larger in diameter than sleeve (38), which serve a purpose described next.

Figure 7:
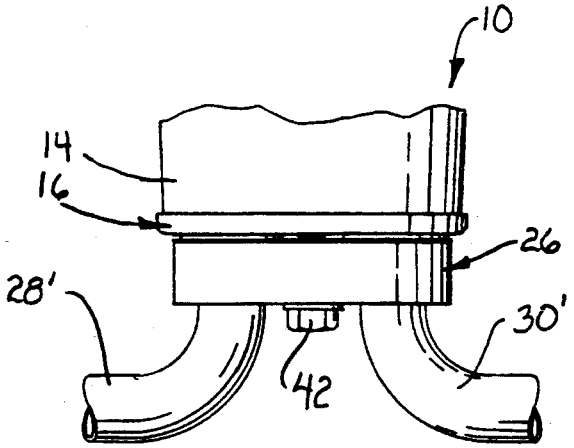
FIG. 7 is a view of the end of the bottom feed embodiment with the tubes in bent orientation.

Referring finally to FIGS. 6 and 7, the last components added are a pair of cylindrical input and output tubes (28) and (30). Tubes (28) and (30) are equal diameter, though not necessarily of equal length, and sized to fit snugly within the bores (44), but not so closely as to be incapable of turning. As disclosed, the tubes (28) and (30) are of aluminum, and so are bendable and formable. This allows either or both to be bent, as illustrated in FIG. 7 and numbered with a prime, and turned to the orientation necessary to meet the respective input and output lines. Their location close to, if not on, the center axis gives added flexibility to the orientation process. Whether bent or not, the tubes (28) and do not protrude out of the side wall of canister (14), and their location proximate the center axis gives a compact package. In the embodiment disclosed, tubes (28) and (30) are brazed into the bores (44), once oriented, so as to provide a complete, static seal. Then, each tube is fixed by a proprietary crimping process to a respective input and output line. Once this is completed, it is a simple matter to bolt block (26) into place, with bolt (42) being tightened into barrel (34). The O-ring seals (40) compress into pocket (36), providing a complete static seal surrounding the inlet and outlet pipes (18) and (20). Both seals are easily made and unmade by the single operation of attaching or detaching block (26) with the single bolt (42). Bolt (42) is accessible between the tubes (28) and (30), more so, in the underhood environment, than a pair of conventional threaded hose type connectors located to either side of canister (14) would be. It would be a very simple matter to remove the entire subassembly of canister (14) and its contents from block (26) and replace it, with no seals being jeopardized. In case of a vehicle redesign, or the necessity of accommodating a different vehicle, the up or down orientation may be changed simply by changing the interior pipes, and differing orientations of the input and output lines may be accommodated simply by changing the bend and turned position of the tubes (28) and (30).

Variations in the embodiment disclosed could be made. A canister other than a cylindrical one would work, and might, in certain circumstances, fit better within the space available. It would then have a preferred orientation, or course, so the orientation of the end cap (16) relative to it would now be significant. A block (26) without sleeves (38) would be possible, although the sleeves (38) do act both to mount the O-rings (40) and to orient and guide the block (26) relative to and into the end cap (16). Therefore, it will be understood that it is not intended to limit the invention to just the embodiments disclosed.

The embodiments of the invention in which an exclusive privilege or property are claimed are defined as follows:

1. A universal, modular accumulator dehydrator assembly kit adapted for use with any of several different vehicle air conditioning systems each of which has input and output lines of varying predetermined orientation and location intended to be joined to said assembly, comprising, a generally cylindrical canister body having an open end, closed end, and uninterrupted side wall, an end cap sized to fit closely in said canister body open end and having an inlet pipe and an outlet pipe opening therethrough, a pair of top feed inlet and outlet pipes and a pair of bottom feed inlet and outlet pipes adapted to be secured to said end cap pipe openings, a detachable block sized to abut said cap and having a pair of protruding sleeves on an inner surface sized to fit into said end cap concentric to said inlet and outlet pipes and a pair of cylindrical bores concentric to said sleeves, and, a bendable, cylindrical input tube and output tube adapted to be connected to said input and output lines respectively and sized to fit closely but movably within said block bores, whereby, a top feed or bottom feed orientation may be chosen for said assembly, after which a pair of input and output tubes may be prebent and turned within said bores so as to be capable of connection to said lines, after which said tubes may be fixed in place in said block bores and said block attached to said end cap.

* * * * *